US010059127B2

(12) United States Patent
Oguchi et al.

(10) Patent No.: US 10,059,127 B2
(45) Date of Patent: Aug. 28, 2018

(54) PRINTER

(71) Applicant: FUJITSU COMPONENT LIMITED, Tokyo (JP)

(72) Inventors: Tatsuya Oguchi, Tokyo (JP); Sumio Watanabe, Tokyo (JP); Yukihiro Mori, Tokyo (JP); Masahiro Tsuchiya, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/592,350

(22) Filed: May 11, 2017

(65) Prior Publication Data

US 2017/0341428 A1 Nov. 30, 2017

(30) Foreign Application Priority Data

May 24, 2016 (JP) ..... 2016-103098

(51) Int. Cl.
*B41J 11/04* (2006.01)
*B41J 2/32* (2006.01)
*B41J 11/00* (2006.01)

(52) U.S. Cl.
CPC ..... *B41J 11/04* (2013.01); *B41J 2/32* (2013.01); *B41J 11/0055* (2013.01)

(58) Field of Classification Search
CPC ..... B41J 11/04; B41J 2/32
See application file for complete search history.

(56) References Cited

U.S. PATENT DOCUMENTS 5,136,340 A * 8/1992 Kohno ..... B41J 15/04 226/196.1
6,744,457 B2 6/2004 Seino et al.
8,911,169 B2 12/2014 Colquitt et al.

FOREIGN PATENT DOCUMENTS

EP 1405730 4/2004
JP 2003-246104 9/2003

* cited by examiner

*Primary Examiner* — Kristal Feggins
*Assistant Examiner* — Kendrick Liu
(74) *Attorney, Agent, or Firm* — IPUSA, PLLC

(57) ABSTRACT

A printer includes a print head and a platen roller. The platen roller includes multiple bearings provided one at each longitudinal end of the platen roller, a roller positioned between the bearings, and multiple flanges of which one is positioned between the roller and one of the bearings and the other is positioned between the roller and the other of the bearings in the longitudinal direction of the platen roller. The flanges have a diameter greater than the diameter of the bearings and the diameter of the roller.

3 Claims, 12 Drawing Sheets

PRINTER

CROSS-REFERENCE TO RELATED APPLICATION

The present application is based upon and claims the benefit of priority of Japanese Patent Application No. 2016-103098, filed on May 24, 2016, the entire contents of which are incorporated herein by reference.

BACKGROUND OF THE INVENTION

1. Field of the Invention

The present invention relates to printers.

2. Description of the Related Art

Printers are widely used for shop registers and automated teller machines (ATMs) or cash dispensers (CDs) in banks.

Such printers employ automatic cutting or manual cutting as a system for cutting recording paper. According to automatic cutting, a movable blade is driven to cut recording paper with a fixed blade and the movable blade. According to manual cutting, a cutter for manually cutting recording paper ("manual cutter") is provided, and the recording paper is manually pulled and cut with the cutter. Reference may be made to Japanese Laid-Open Patent Application No. 2003-246104 for related art.

SUMMARY OF THE INVENTION

According to an aspect of the present invention, a printer includes a print head and a platen roller. The platen roller includes multiple bearings provided one at each longitudinal end of the platen roller, a roller positioned between the bearings, and multiple flanges of which one is positioned between the roller and one of the bearings and the other is positioned between the roller and the other of the bearings in the longitudinal direction of the platen roller. The flanges have a diameter greater than the diameter of the bearings and the diameter of the roller.

DESCRIPTION OF THE EMBODIMENTS

Figure 1A:
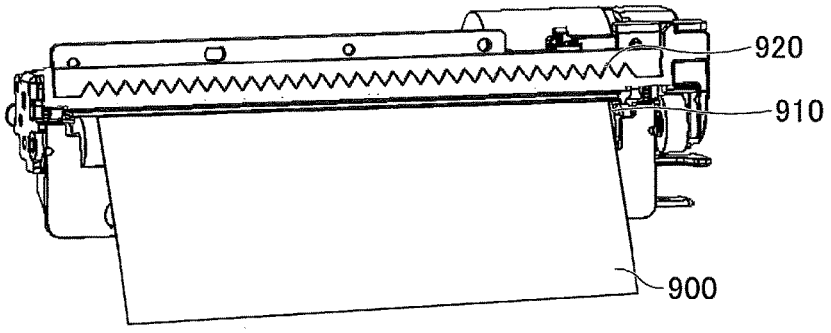
FIGS. 1A through 1C are diagrams illustrating a printer.

According to manual cutting, when recording paper is manually pulled and cut, the recording paper may be pulled sideways to be displaced to the side from a predetermined position. When displaced from a predetermined position, the recording paper held between a thermal head and a platen roller may be obliquely conveyed by the rotating platen roller, thus becoming jammed or being wrapped around the platen roller to be drawn inside.

Therefore, there is a demand for printers in which recording paper remaining after being cut with a manual cutter is prevented from being obliquely conveyed to, for example, become jammed.

According to an aspect of the present invention, it is possible for printers with a manual cutter to prevent recording paper remaining after being subjected to cutting with the manual cutter from being obliquely conveyed to, for example, become jammed.

Embodiments of the present invention are described below with reference to the accompanying drawings. In the following description, the same elements are referred to using the same reference numeral, and a repetitive description thereof is omitted.

Figure 1B:
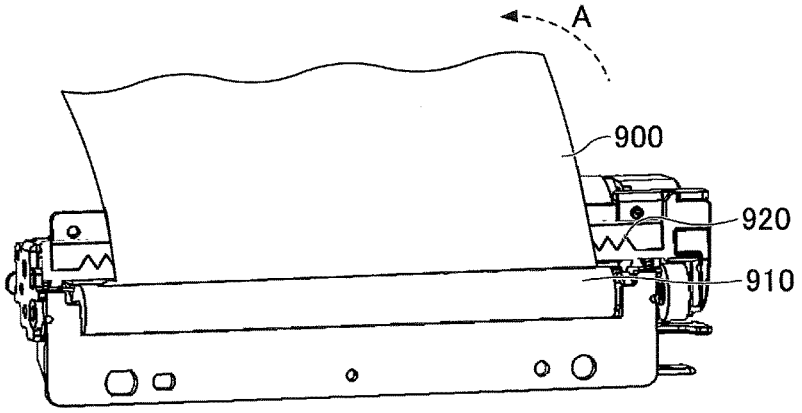
Figure 1C:
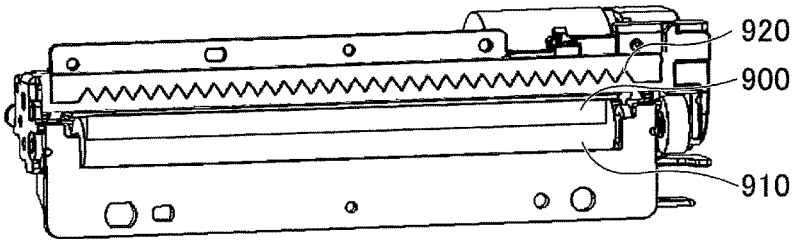

First, a printer including a manual cutter is described with reference to FIGS. 1A through 1C. According to a printer including a manual cutter, recording paper 900 is conveyed by the rotation of a platen roller 910 to be discharged outside the printer as depicted in FIG. 1A, and after printing, the recording paper 900 is brought into contact with a manual cutter 920 and pulled in the direction indicated by the dashed arrow A as depicted in FIG. 1B. As a result, the recording paper 900 is cut. At this point, a force is applied to the recording paper 900 in the direction indicated by the dashed arrow A. Therefore, the recording paper 900 remaining after being cut with the manual cutter 920 may be displaced sideways from a predetermined position as depicted in FIG. 1C. The recording paper 900 in a displaced position may be obliquely conveyed by the platen roller 910 to become jammed.

Figure 2A:
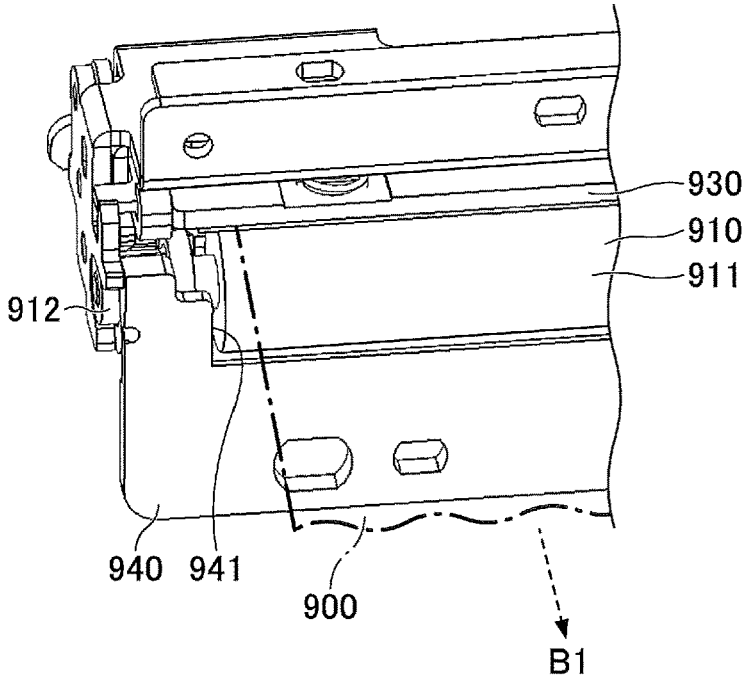
FIGS. 2A and 2B are diagrams illustrating the printer.
Figure 2B:
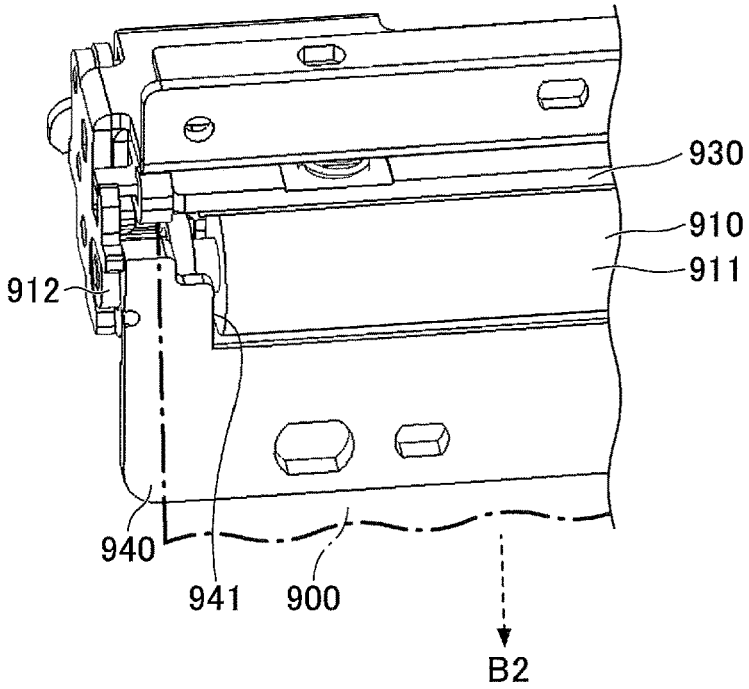

FIG. 2A illustrates normal conveyance of the recording paper 900. Referring to FIG. 2A, the recording paper 900 is conveyed while held between a roller 911 of the platen roller 910 and a thermal head 930. The platen roller 910 has a bearing 912 supported by a bracket 940. The recording paper 900 is indicated by a one-dot chain line for convenience of description. When obliquely conveyed, the recording paper 900, as depicted in FIG. 2B, moves widthwise to partly protrude from the roller 911 and go beyond a paper guide 941 provided on the bracket 940. Therefore, the recording paper 900 may enter a gap between the bracket 940 and the bearing 912 or contact the bracket 940 to become jammed. In FIGS. 2A and 2B, the conveyance direction of the recording paper 900 is indicated by the dashed arrows B1 and B2, respectively.

Figure 3A:
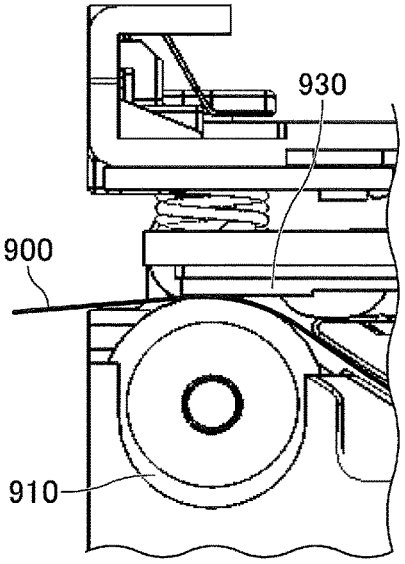
FIGS. 3A and 3B are diagrams illustrating the printer.
Figure 3B:
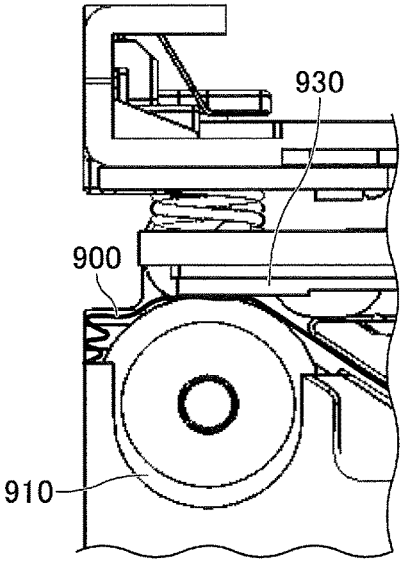

When normally conveyed as depicted in FIG. 3A, the recording paper 900 is normally discharged out of the printer without becoming jammed. When obliquely conveyed, however, the recording paper 900 may become jammed on the downstream side of the platen roller 910 as depicted in FIG. 3B to be prevented from being normally discharged.

[a] First Embodiment

Figure 4A:
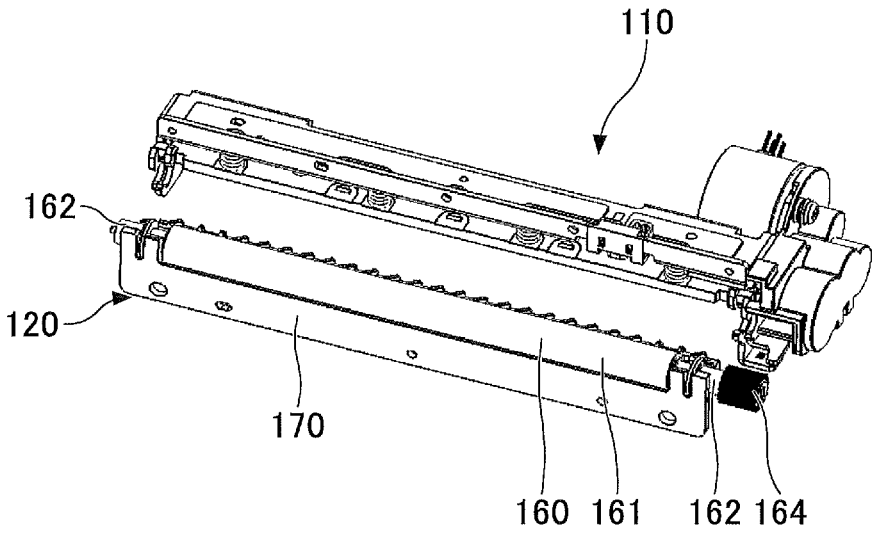
FIGS. 4A and 4B are perspective views of a printer according to a first embodiment.
Figure 4B:
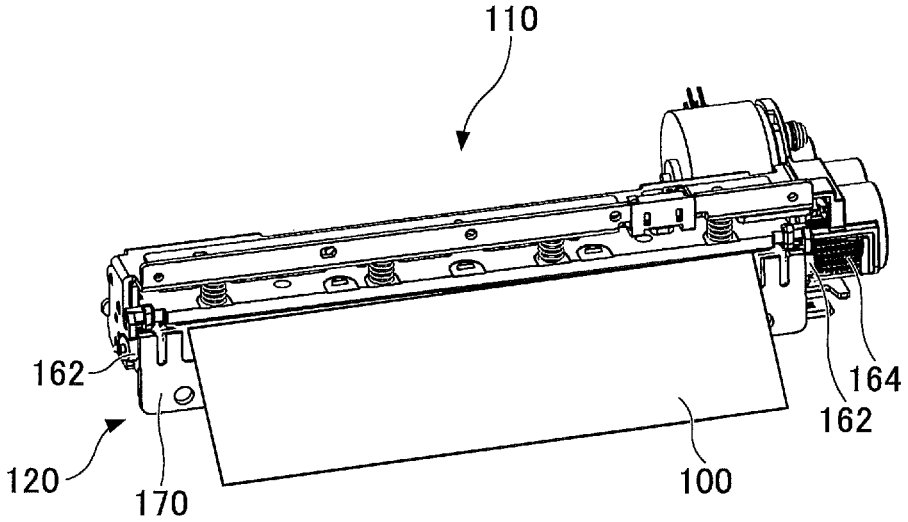

Next, a printer according to a first embodiment is described. Referring to FIGS. 4A and 4B, a printer according to this embodiment includes a printer mechanism unit 110 and a platen unit 120 separably connected to the printer mechanism unit 110. FIG. 4A depicts the printer mechanism unit 110 and the platen unit 120 that are separated. FIG. 4B is a perspective view of the printer mechanism unit 110 and the platen unit 120 that are connected.

The platen unit 120 includes a platen roller 160 and a bracket 170 to which the platen roller 160 is attached. The platen roller 160 includes a roller 161 and bearings 162 one provided at each end of a shaft 160*a* (FIG. 6A) of the platen roller 160 projecting from both longitudinal (axial) ends of the roller 161. A gear 164 configured to rotate the platen roller 160 is provided at the outer end of one of the bearings 162 in the longitudinal (axial) direction of the platen roller 160.

Figure 5A:
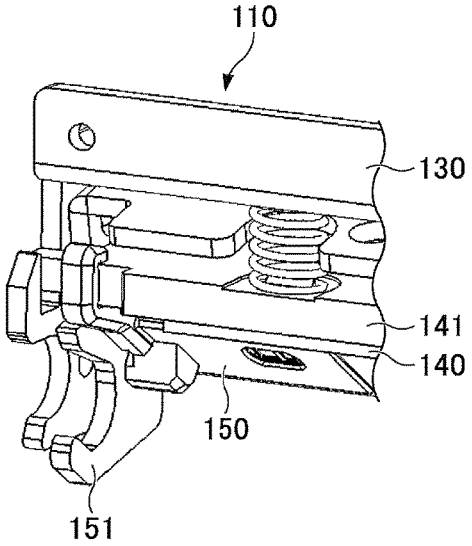
FIGS. 5A and 5B are diagrams illustrating the printer according to the first embodiment.
Figure 5B:
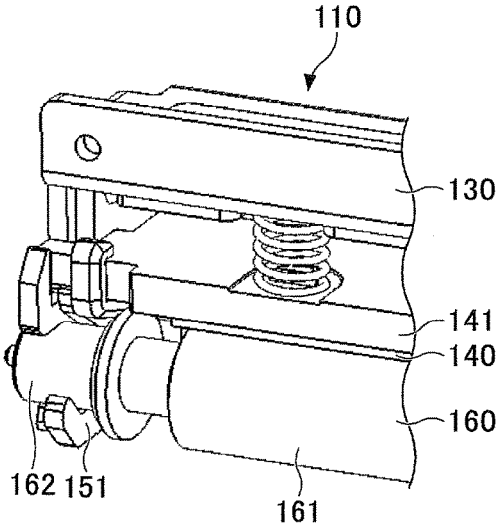

Referring to FIG. 5A, the printer mechanism unit 110 includes a frame 130, and a thermal head 140 (a print head), a heat sink 141, and a paper guide 150, which are attached to the frame 130. Furthermore, lock levers 151 that support the bearings 162 of the platen roller 160 are provided on the frame 130. The bearings 162 are accommodated in the lock levers 151 as depicted in FIG. 5B to connect the printer mechanism unit 110 and the platen unit 120.

Figure 6A:
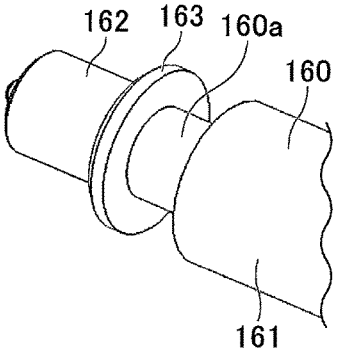
FIGS. 6A and 6B are diagrams illustrating the printer according to the first embodiment.
Figure 6B:
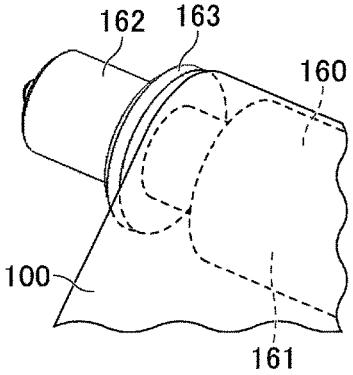

As depicted in FIG. 6A, the platen roller 160 includes flanges 163 one provided inside, for example, at the inner end of, each of the bearings 162 in the longitudinal (axial) direction of the platen roller 160. That is, one of the flanges 163 is positioned between one of the bearings 162 and one of the longitudinal (axial) ends of the roller 161, and the other of the flanges 163 is positioned between the other of the bearings 162 and the other of the longitudinal (axial) ends of the roller 161. The flanges 163 are greater in diameter than the bearings 162. As depicted in FIG. 6B, even when recording paper 100 is obliquely conveyed, an end of the recording paper 100 contacts the inside of the flange 163 to be prevented from protruding outward from the flange 163. This makes it possible to prevent an edge of the recording paper 100 in its width direction from contacting the bracket 170 to restrict the oblique conveyance of the recording paper 100. Accordingly, it is possible to prevent the recording paper 100 from becoming jammed.

Figure 7A:
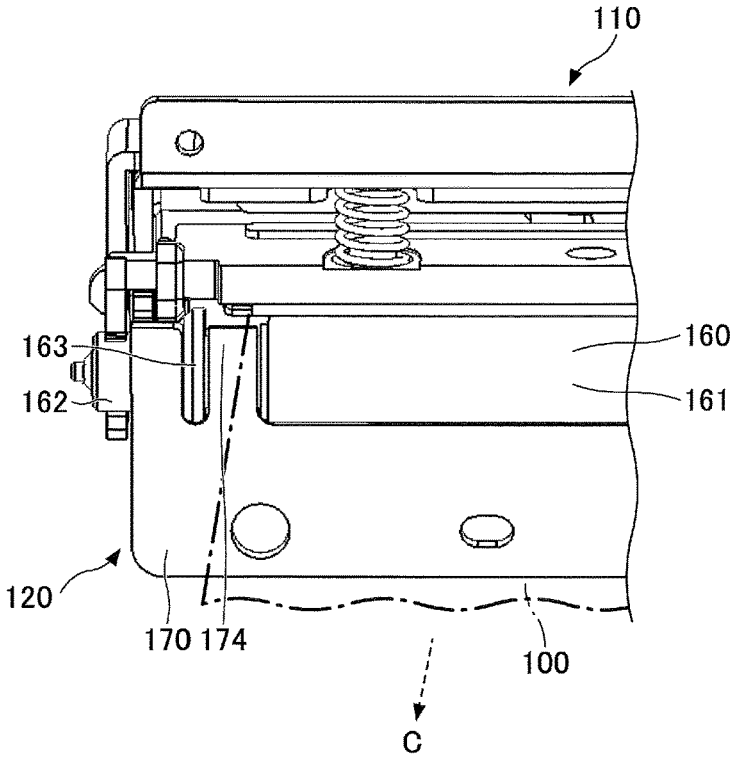
FIGS. 7A and 7B are diagrams illustrating the printer according to the first embodiment.
Figure 7B:
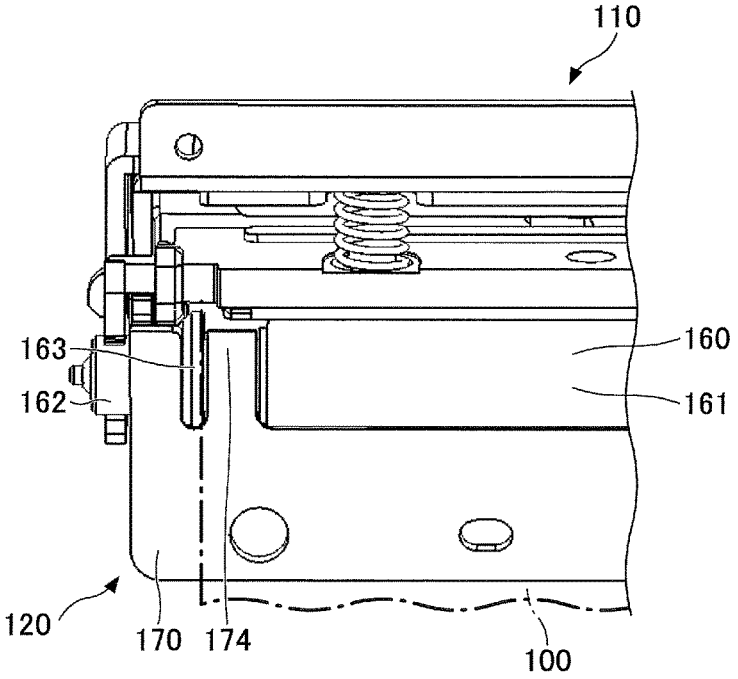

Thus, even when the recording paper 100 is obliquely conveyed in the direction indicated by the dashed arrow C as depicted in FIG. 7A to go beyond recording paper guides 174 ("guides 174") as depicted in FIG. 7B, an edge of the recording paper 100 contacts the flange 163 to prevent the recording paper 100 from protruding out of the flange 163. Accordingly, the oblique conveyance of the recording paper 100 is restricted. In FIGS. 7A and 7B, the recording paper 100 is indicated by a one-dot chain line for convenience of description.

Figure 8:
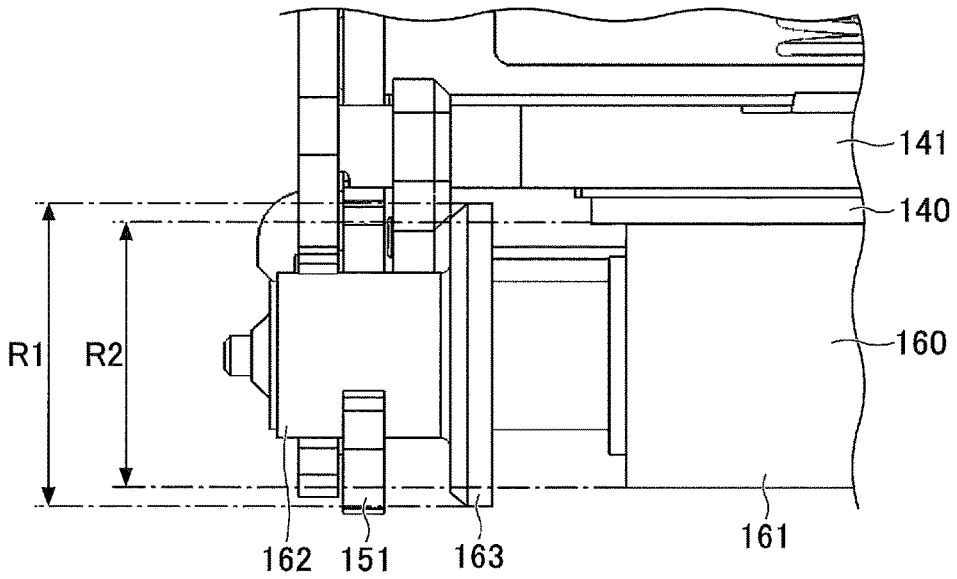
FIG. 8 is a diagram illustrating the printer according to the first embodiment.

Furthermore, referring to FIG. 8, the flanges 163 have a diameter R1 greater than a diameter R2 of the roller 161. The recording paper 100 is conveyed while held between the roller 161 and the thermal head 140. Therefore, when the diameter R1 is greater than the diameter R2, an edge of the recording paper 100 contacts the corresponding flange 163 even when the recording paper 100 is obliquely conveyed. Therefore, the recording paper 100 is prevented from protruding out of the flange 163. Thus, the oblique conveyance of the recording paper 100 is restricted by the flanges 163 to prevent the recording paper 100 from becoming jammed.

Each of the flanges 163 is formed together with one of the bearings 162 as one piece. The bearings 162 may be formed of either a resin material or a metal material. Alternatively, the flanges 163 may be provided on or around the shaft 160*a* separately from the bearings 162.

[b] Second Embodiment

Next, a second embodiment is described. One of the features of a printer according to this embodiment is a structure of a bracket.

Figure 9A:
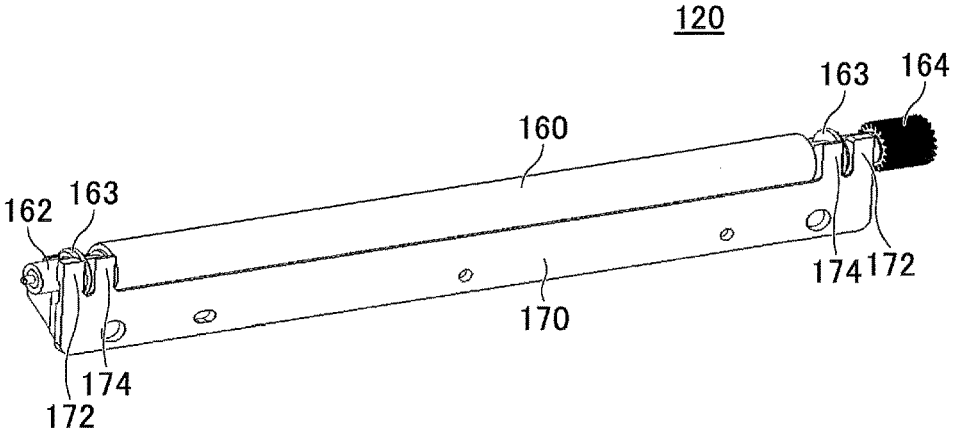
FIGS. 9A and 9B are structure diagrams of a platen unit of a printer according to a second embodiment.
Figure 9B:
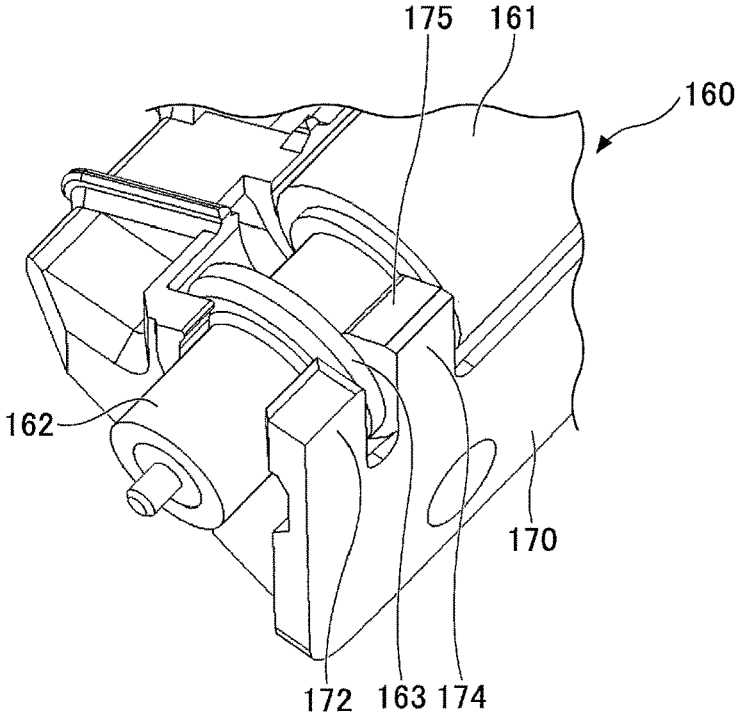
Figure 10A:
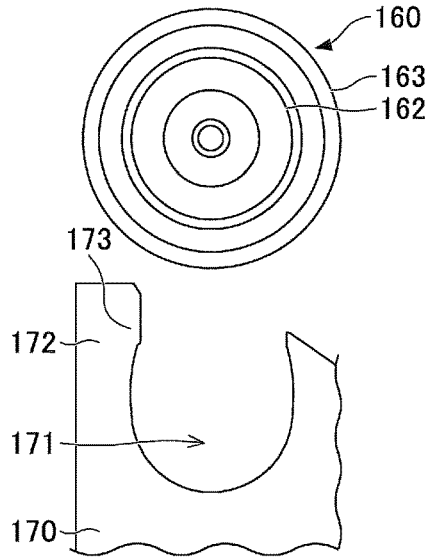
FIGS. 10A through 10C are diagrams illustrating the printer according to the second embodiment.
Figure 10B:
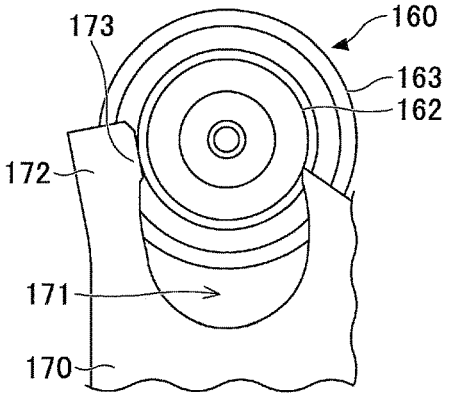
Figure 10C:
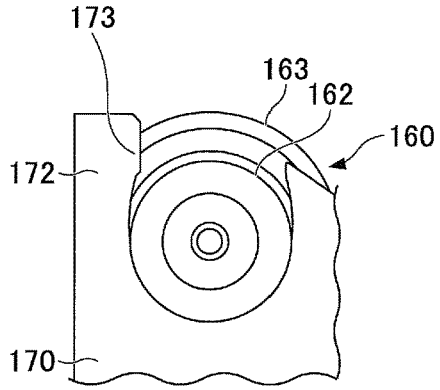

According to a printer of this embodiment, as depicted in FIGS. 9A and 9B, the platen roller 160 is attached to the bracket 170 in the platen unit 120. The bracket 170 is formed of a flexible material such as a resin material. Referring to FIGS. 10A through 10C, the bracket 170 includes openings 171 that accommodate the bearings 162, and snap-fit parts 172 one formed at the entrance of each of the openings 171. The snap-fit parts 172 are provided one at each longitudinal end of the bracket 170. Each snap-fit part 172 includes a projection 173 that projects at the entrance of one of the openings 171.

To attach the platen roller 160 to the bracket 170, the bearings 162 are caused to enter the openings 171 through their respective entrances from the position depicted in FIG. 10A. At this point, as depicted in FIG. 10B, the bearings 162 contact and press the projections 173 of the snap-fit parts 172 to flex the snap-fit parts 172 outward. Thereafter, when the bearings 162 are completely accommodated in the openings 171, the snap-fit parts 172 return to their original positions to fix the platen roller 160 to the bracket 170. In this state, the bearings 162 are supported by the snap-fit parts 172, specifically, the projections 173. Therefore, unless a force is applied to the bearings 162, the bearings 162 do not come out of the openings 171.

Figure 11A:
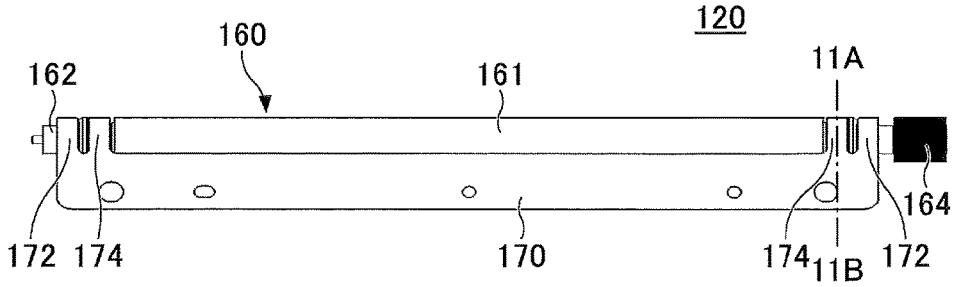
FIGS. 11A and 11B are structure diagrams of the platen unit of the printer according to the second embodiment.
Figure 11B:
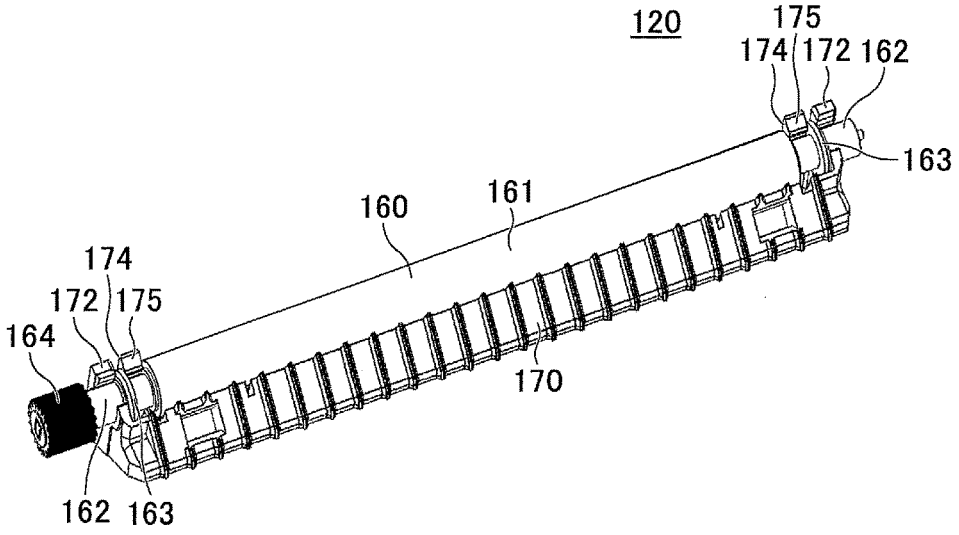

FIGS. 11A and 11B are a front elevational view and a perspective view, respectively, of the platen unit 120 according to this embodiment. Referring to FIGS. 11A and 11B, the bracket 170 further includes the guides 174. The guides 174 are positioned inside (between) the snap-fit parts 172 in the longitudinal direction of the bracket 170. With the platen roller 160 being attached to the bracket 170, each of the guides 174 is positioned between one of the longitudinal (axial) ends of the roller 161 and one of the flanges 163 as depicted in FIG. 9B. As a result, even when the recording paper 100 is obliquely conveyed to protrude out of the roller 161, the recording paper 100 is discharged along either guide 174. Therefore, the recording paper 100 can be discharged without being wrapped around the roller 161 to be drawn inside. The snap-fit parts 172 are positioned outside the flanges 163.

Figure 12:
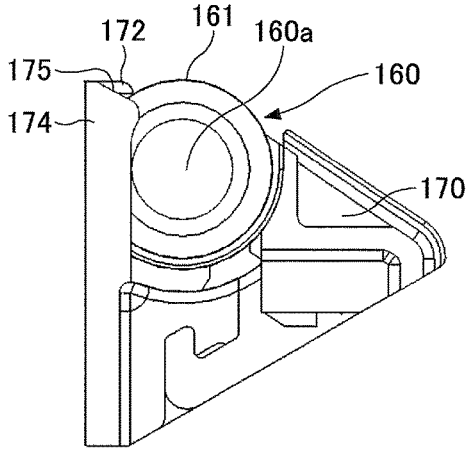
FIG. 12 is a diagram illustrating the printer according to the second embodiment.
Figure 13A:
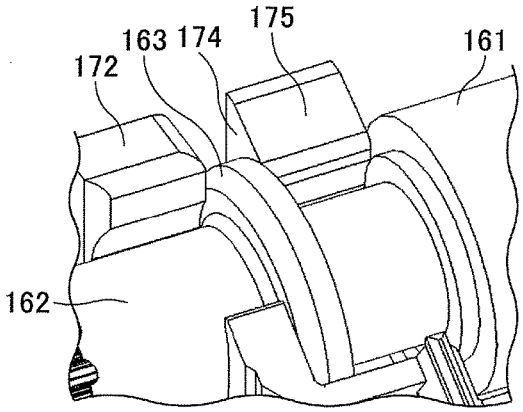
FIGS. 13A and 13B are diagrams illustrating the printer according to the second embodiment.
Figure 13B:
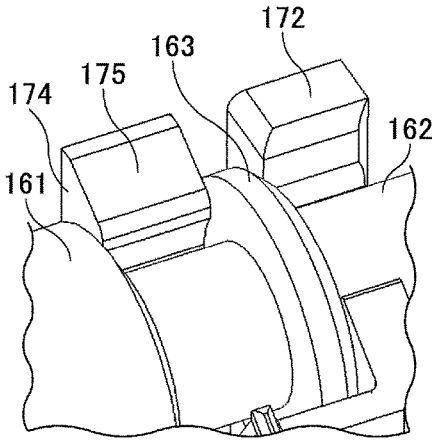
Figure 14:
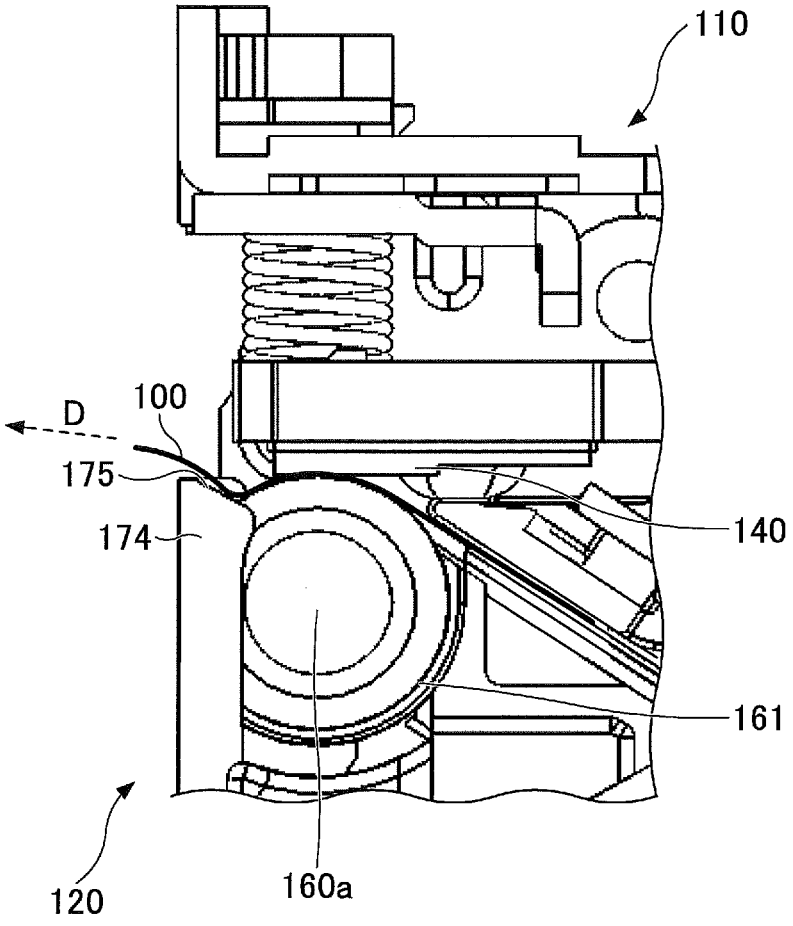
FIG. 14 is a diagram illustrating the printer according to the second embodiment.

Furthermore, referring to FIGS. 12, 13A and 13B, an upper surface of each guide 174 includes a slope 175. FIG. 12 is a cross-sectional view of the platen unit 120, taken along the one-dot chain line 11A-11B of FIG. 11A. FIG. 13A is an enlarged view of part of the platen unit 120 in which the left-side guide 174 is provided. FIG. 13B is an enlarged view of part of the platen unit 120 in which the right-side guide 174 is provided. Referring also to FIG. 14, the slope 175 extends outward from a position that is radially inside the periphery of the roller 161 when viewed in the axial direction of the roller 161. As depicted in FIG. 12, the slope 175 is a downward slope toward the shaft 160*a* of the platen roller 160. Therefore, when obliquely conveyed to get on either guide 174, the recording paper 100 is guided along the slope 175 in the direction indicated by the dashed arrow D in FIG. 14. Therefore, the recording paper 100 is prevented from entering a gap between the bracket 170 and either bearing 162 or contacting the bracket 170 to become jammed. Accordingly, the recording paper 100 is prevented from becoming jammed around the guides 174.

In other respects than those described above, the second embodiment may be the same as the first embodiment.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A printer comprising:

a print head;

a platen roller, the platen roller including a plurality of bearings provided one at each of longitudinal ends of the platen roller;

a roller positioned between the plurality of bearings; and a plurality of flanges, of which one is positioned between the roller and one of the plurality of bearings and the other is positioned between the roller and the other of the plurality of bearings in a longitudinal direction of the platen roller, the plurality of flanges having a diameter greater than a diameter of the plurality of bearings and a diameter of the roller; and a platen unit including a bracket to which the platen roller is attached, the bracket being formed of a flexible material, wherein the bracket includes a plurality of snap-fit parts formed one at an entrance of each of a plurality of openings that accommodate the plurality of bearings, the plurality of openings being formed one at each of longitudinal ends of the bracket, and the plurality of snap-fit parts are configured to flex to allow an entry of the plurality of bearings into the plurality of openings through the entrances thereof, when contacted by the plurality of bearings at a time of attaching the platen roller to the bracket.

2. The printer as claimed in claim 1, wherein the bracket further includes a plurality of guides configured to guide recording paper, and one of the plurality of guides is positioned between the one of the plurality of bearings and the roller, and the other of the plurality of guides is positioned between the other of the plurality of bearings and the roller.

3. The printer as claimed in claim 2, further comprising:

a printer mechanism unit including the print head, wherein a surface of each of the plurality of recording guides facing the printer mechanism unit includes a slope, and the recording paper is discharged along the slope.

* * * * *